US010876189B2

(12) United States Patent
Bertoncello et al.

(10) Patent No.: US 10,876,189 B2
(45) Date of Patent: Dec. 29, 2020

(54) AGE-HARDENABLE STERLING SILVER ALLOY WITH IMPROVED "TARNISHING" RESISTANCE AND MASTER ALLOY COMPOSITION FOR ITS PRODUCTION

(71) Applicant: LEGOR GROUP S.P.A., Bressanwido (IT)

(72) Inventors: Riccardo Bertoncello, Bressanwido (IT); Massimo Poliero, Vicenza (IT)

(73) Assignee: LEGOR GROUP S.P.A., Bressanvido (IT)

( * ) Notice: Subject to any disclaimer, the term of this patent is extended or adjusted under 35 U.S.C. 154(b) by 264 days.

(21) Appl. No.: 15/748,927

(22) PCT Filed: Jul. 26, 2016

(86) PCT No.: PCT/IB2016/054454
§ 371 (c)(1),
(2) Date: Jan. 30, 2018

(87) PCT Pub. No.: WO2017/021818
PCT Pub. Date: Feb. 9, 2017

(65) Prior Publication Data

US 2019/0003015 A1 Jan. 3, 2019

(30) Foreign Application Priority Data

Jul. 31, 2015 (IT) ..... UB2015A2713
Aug. 6, 2015 (IT) ..... UB2015A2954

(51) Int. Cl.

| | |
|---|---|
| ***C22C 5/06*** | (2006.01) |
| ***C22C 1/03*** | (2006.01) |
| ***C22C 18/00*** | (2006.01) |
| ***C22F 1/14*** | (2006.01) |
| ***C22C 9/04*** | (2006.01) |

(52) U.S. Cl.
CPC ..... *C22C 5/06* (2013.01); *C22C 1/03* (2013.01); *C22C 9/04* (2013.01); *C22C 18/00* (2013.01); *C22F 1/14* (2013.01)

(58) Field of Classification Search
CPC ..... C22C 5/06; C22C 1/03
See application file for complete search history.

(56) References Cited

U.S. PATENT DOCUMENTS

| | | | | |
|---|---|---|---|---|
| 3,929,475 | A * | 12/1975 | Ingersoll | A61K 6/046 420/505 |
| 4,810,308 | A * | 3/1989 | Eagar | C22C 5/08 148/405 |
| 5,021,214 | A | 6/1991 | Sasaki et al. | |
| 5,037,708 | A * | 8/1991 | Davitz | A44C 27/003 420/503 |
| 5,039,479 | A | 8/1991 | Bernhard et al. | |
| 5,817,195 | A | 10/1998 | Davitz | |
| 5,882,441 | A | 3/1999 | Davitz | |
| 6,245,166 | B1 | 6/2001 | Shibuya et al. | |
| 6,841,012 | B2 | 1/2005 | Croce | |
| 7,128,792 | B2 | 10/2006 | Menon | |
| 8,771,591 | B1 * | 7/2014 | Bennett | C22C 5/06 420/503 |
| 9,267,191 | B2 | 2/2016 | Raykhtsaum | |
| 2005/0186107 | A1 * | 8/2005 | Davitz | C22C 5/08 420/504 |
| 2006/0045792 | A1 | 3/2006 | Agarwal et al. | |
| 2013/0112322 | A1 * | 5/2013 | Butler | A44C 27/003 148/538 |
| 2014/0127075 | A1 | 5/2014 | Raykhtsaum | |
| 2019/0003015 | A1 * | 1/2019 | Bertoncello | C22C 1/03 |

FOREIGN PATENT DOCUMENTS

| | | | | |
|---|---|---|---|---|
| EP | 3329024 | A2 * | 6/2018 | C22C 1/02 |
| JP | 62010231 | | 1/1987 | |
| JP | H01275726 | A | 11/1989 | |
| JP | H02160196 | A | 6/1990 | |
| JP | 2000226626 | A | 8/2000 | |
| WO | 2011065922 | A1 | 6/2011 | |
| WO | WO-2011065922 | A1 * | 6/2011 | A44C 27/003 |
| WO | 2013057480 | A1 | 4/2013 | |

OTHER PUBLICATIONS

International Search Report for PCT/IB2016/054454 dated Feb. 1, 2017.

* cited by examiner

*Primary Examiner* — Christopher S Kessler
*Assistant Examiner* — Jiangtian Xu
(74) *Attorney, Agent, or Firm* — Abelman Frayne & Schwab

(57) ABSTRACT

The present invention relates to a sterling silver alloy, copper-free in its basic embodiment, age-hardenable, with improved resistance to tarnishing, thanks to the presence of palladium in combination with zinc and indium, this alloy being mainly used for the realization of precious articles; the present invention also relates to a master alloy composition suitable for the production of said sterling silver alloy.

2 Claims, No Drawings

AGE-HARDENABLE STERLING SILVER ALLOY WITH IMPROVED "TARNISHING" RESISTANCE AND MASTER ALLOY COMPOSITION FOR ITS PRODUCTION

RELATED APPLICATIONS

This application is a national phase of International Application No. PCT/182016/054454 filed Jul. 26, 2016, and claims priority from Italian Patent Application Nos. UB2015A002713 filed Jul. 31, 2015 and UB2015A002954 filed Aug. 6, 2015, all incorporated by reference in their entirety.

TECHNICAL FIELD

The present invention relates to an age-hardenable sterling silver alloy, copper-free in its basic embodiment and comprising the essential elements, with improved resistance to tarnishing, mainly used for the realization of valuable articles such as jewellery, silverware, coins and medals.

The present invention also concerns a master alloy for obtaining the aforesaid sterling silver alloy.

It should be noted from the outset that the invention is mainly based on the thermo-hardening properties of master alloy compositions (and resulting final sterling silver alloys) typically and preferably free of copper (Cu), and which exploit a combination of zinc (Zn) and indium (In) together with palladium (Pd) to reach hardness values that are suitable for the production of jewellery. Copper (Cu) has shown itself to be an optional element that may not necessarily be present in the master alloy (or in the sterling silver alloy obtained therefrom), without this negatively affecting the results to be achieved, namely the desired hardness for the sterling silver alloy.

In return, the greater resistance to tarnishing of the sterling silver alloy of the present invention mainly derives precisely from not having included copper (Cu) in the alloy and from the optimal combination, studied and selected by the Applicant, of the other elements (palladium (Pd), zinc (Zn) and indium (In) to be exact) present in the alloy.

PRIOR ART

Among the precious metals used in jewellery, as is known, silver (Ag) is the whitest; it is also, in its pure state, an extremely soft metal, with a Vickers hardness in the order of 20-25 HV.

In order to obtain a reinforcement of the structure and a consequent increase in hardness, in the field of silverware there is a consolidated use of silver in combination with copper (Cu); one of the most commonly used silver/copper ratios is the ratio 925/75—an alloy generally known as "standard sterling silver"—which in the "as cast" state (i.e. after casting, before any processing or treatment) has hardness values of around 60-70 HV which, although not extremely high, give the articles a higher resistance to wear and deformation than pure silver does.

Generally speaking, sterling silver is referred to as being all those alloys that have a minimum silver (Ag) content equal to 925‰; the remaining part (75‰) may be copper (Cu) or other so-called "alloying" elements (i.e. those elements that, in an alloy, tend to distort the lattice of the solvent, hindering the motion of the dislocations and thus affording the material a greater resistance).

Sterling silver can be hardened up to 120-140 HV with a thermal process that includes a first step of solubilization at 730° C. for about 30-60 minutes and subsequent cooling in water, and a second step of tempering at 300° C. for 60-90 minutes to achieve the desired hardening.

Alternatively, sterling silver can be hardened from the "as cast" state up to 100-110 HV by means of a tempering treatment at 300° C. for 60-90 minutes if the metal undergoes relatively fast cooling (4-6 minutes) after casting the alloy.

The hardening of standard sterling silver achieved with the known processes described above occurs thanks to the fact that small precipitates rich in copper are formed in the microstructure; so that this precipitation is metallurgicaily possible, it is necessary for there to be present in the alloy at least 3% by weight or copper (Cu), a value exceeding that of the maximum solubility of this metal into Silver (Ag).

Standard sterling silver is not however free from some acknowledged drawbacks; in fact, one or its basic problems is a difficulty in preserving its original colour over time.

Standard sterling silver tends, in fact, to brown or blacken, be it uniformly or locally, more or less quickly according to the characteristics of the environment in which the various articles made with it are situated; these changes in colour and consequent loss of the typical silvery-white colouring, which are due to oxidative phenomena commonly called tarnishing in the jewellery industry, lead to a depreciation of the article and to the need to resort to surface treatments that can remove or prevent the dark layer.

A known way of obtaining sterling silver alloys with improved resistance to tarnishing is to replace the copper with other metals such as zinc (Zn), indium (In) or tin (Sn) which, unlike copper (Cu), are highly silver soluble even at room temperature and allow the formation of monophasic alloys.

It is in fact well known in the relevant sector that it is precisely thanks to the monophasic metallurgical state that it is possible to effectively increase an alloys resistance to tarnishing; however, these alloys have the drawback—widely recognized in the relevant field—of a poor hardness that is insufficient to produce precious articles or jewellery having a mechanical strength that is adequate for the market.

There are some recent patents, such as U.S. Pat. Nos. 5,817,195, 5,882,441, 5,021,214, 6,841,012 and 7,128,792, which describe alloys that are copper-free or have a reduced content of this element (maximum value equal to 3% by weight), to which are added one or more base elements (Zn, In, Sn, Ga) and small quantities of silicon (Si) that acts as a deoxidizer and/or which forms a protective layer of silicon oxide on the surface of the articles produced with such alloys. However, these alloys have a low hardness (between 35 and 60 HV for the maximum value of copper (Cu) considered) and cannot be hardened by heat treatment; it should, furthermore, be noted that none of these alloys contains any noble metals (in particular palladium) in addition to silver.

Another known approach to improving sterling silver's resistance to tarnishing is the partial replacement of the copper by noble metals such as gold (Au), platinum (Pt) or palladium (Pd) which, in themselves, have a higher resistance to tarnishing than silver.

Concrete examples of these solutions are found in United States patent applications published under Nos. US2013/112322 and US2014/127075 (or U.S. Pat. No. 9,267,191B2, in the granted patent version) that describe alloys having a high "as cast" hardness (over 100 HV) and improved resistance to tarnishing which, however, is evident only in respect of corrosive compounds containing chlorine (Cl)

while, in environments that are rich in sulphur (S) or its compounds, these alloys have an inadequate resistance.

The high "as cast" hardness and the propensity to hardening are clue to the combined use of significant amounts of copper and palladium (copper (Cu) between 2.8% and 4.5% by weight, palladium (Pd) between 1% and 4% by weight), while the content of the basic elements, in particular of zinc (Zn) and tin (Sn), is limited to a maximum quantity equal to 1.25% by weight.

However, alloys thus formulated have some drawbacks, of which the main ones are high costs due to the use of noble metals and insufficient resistance to tarnishing, especially in sulphur (S)-rich environments, due to the high content of copper (Cu) used.

The published patent US2014/127075 (or U.S. Pat. No. 9,267,191B2) also describes alloys free of copper (Cu), with a content of palladium of between 1% by weight and 3.5% by weight, of zinc (Zn) in a concentration of between 1.1% and 1.5% by weight and of silicon (Si) in a concentration equal to 0.035% by weight. The alloys described in these prior art documents do not provide for the use of indium (In).

With reference to the results presented below to describe the present invention, it is presumed that the excellent hardening properties of the known composition described above are due to the formation of Pd—Si based intermetallic compounds, and not to the introduction of the limited quantity of zinc (Zn).

A further method capable of improving a sterling silvers resistance to tarnishing consists in adding significant quantities of germanium (Ge) (indicatively between 0.5% by weight and 1.5% by weight) and silicon (Si) (indicatively between 0.05% by weight and 0.2% by weight), or mixtures thereof, to create a surface layer of transparent oxides (germanium oxides and/or silicon oxides) that protects against the more aggressive environmental agents, above all sulphur compounds.

While possessing an "as cast" hardness and a propensity to hardening comparable to those of standard sterling silver, these alloys, whose anti-oxidative action is based on the presence of a thin surface layer of transparent oxides, however, show their limits when the surface layer unfavourably deteriorates or cracks—as can furthermore easily happen due to the different mechanical strength and the different expansibility of the oxide surface layer with respect to the underlying ally—, thereby exposing the manufactured product to the action of atmospheric agents that reactivate the oxidative reactions that cause browning or blackening. Furthermore, since the tarnishing of silver alloys is not only caused by sulphur compounds but also by chlorine compounds, which are for example contained in human perspiration, the alloys on which a surface layer of transparent oxides is formed have been shown to fail in laboratory corrosion rests with chlorine compounds, and to present insufficient resistance to long term corrosion: this makes them unsuitable for the production of articles of jewellery destined to last over time in different environments.

A solution, which aims to overcome the above limitations, is described in the U.S. patent published under U.S. Pat. No. 8,771,591: it provides for the creation of silver alloys with low Cu content (between 0.4% and 0.45% by weight, although always present) in combination with small quantities of precious metals (Pd: up to a maximum value of 1% by weight; Pt and Au: up to a maximum value of 0.5% by weight) and other elements, such as Ge (0.25÷0.5% by weight) and/or cobalt (Co) (0.2%÷0.25% by weight) that are in any event considered fundamental for obtaining an optimum resistance to tarnishing; in any case, precisely because it is oriented exclusively to the improvement of the resistance to tarnishing, this solution inevitably has the drawback of giving rise to a low hardness in the alloy, unacceptable for precious articles (jewellery) having an adequate mechanical strength.

Another solution, described in the international patent application published under No. WO2013/057480 A1, provides for the addition of palladium (Pd) up to a maximum value of 1% by weight, generally in combination with an amount of germanium (Ge) comprised between 0.7 and 1.65% by weight; however, the simultaneous presence of (Pd) and (Ge) causes the formation of unwanted and coarse second phases that are rich in both the elements in question, which drastically reduce the potential benefits in terms of resistance to tarnishing.

The aforesaid published patent WO2013/057480 A1 also shows examples of silver alloy compositions that use zinc (Zn) and indium (In) without however combining them with palladium (Pd) (e.g. "JM905" "JM910" and "JM930"). In the specific case of the alloy called "Autium 925" the use of palladium (Pd, as a percentage of 1%) is also provided for, but only in combination with zinc (Zn), copper (Cu) and gold (Au): this specific formulation ("Autium 925"), therefore, does not in any way mention the use of indium (In) with the aim of improving the alloys' resistance to tarnishing or its thermo-hardening characteristics.

In addition, the independent and main claim of said patent obligatorily provides for germanium (Ge), boron (B) and copper (Cu). The aim of WO2013/057480 A1 also is to obtain a silver alloy with improved corrosion resistance and there is no mention of any hardening properties.

The prior art document published under WO2011/065922 A1 describes silver alloys that provide for a combination of palladium (Pd), and zinc (Zn), as well as of beryllium (Be) and strontium (Sr): this prior art document describes alloys that are resistant to tarnishing but does not mention any thermo-hardening mechanism of the alloys themselves.

The prior art document JP2000226626 A, as well as providing for elements extraneous to the present invention, does not mention zinc (Zn) as an element to be included in the silver alloy: the invention described in JP2000226626 A also has the aim of obtaining an alloy that is resistant to tarnishing without any reference being made to the silver alloys thermo-hardening properties.

The prior art document published under JPH01275726 A shows the use of palladium (Pd) in combination with indium (In) and ruthenium (Ru) to improve the silver alloys resistance to tarnishing: this document does not mention zinc (Zn) and reports no effect on the silver alloys hardening capacity given by the combination of indium (In) and palladium (Pd), but only on its improved resistance to tarnishing.

The prior document JPS6210231 A, in its very title, differs significantly from the present invention: the alloys shown in this prior art document provide for the use of Silver (Ag) in combination with palladium (Pd) and/or, in certain cases, with Platinum (Pt) together with one of the following three elements: zinc (Zn), indium (In) or tin (Sn).

Composition 4 in Table 1 of JPS6210231 A provides for 90% Silver (Ag), 1% palladium (Pd), 7% indium (In) and 1% zinc (Zn); composition 5 in Table 1 of JPS6210231 A provides for 92.5% Silver (Ag), 1% palladium (Pd) and 6.5% indium (In); composition 7 in Table 1 of JPS6210231 A provides for the use of indium (In), platinum (Pt) and palladium (Pd) in combination with silver (Ag) in a percentage of 95%. Composition 9 in table 1 of JPS6210231 A provides for 92.5% Silver, 2.5% palladium (Pd), 1% indium (In) and 4% zinc (Zn). JPS6210231 A does not indicate that the use of palladium (Pd) in combination with the other elements serves to improve the hardness of the alloy but only to improve its resistance to tarnishing.

The prior art document published under JPH02160196 A describes silver alloys for soldering and explains the use of indium (In), palladium (Pd), nickel (Ni) and antimony (Sb) to improve the behaviour of the soldering. This prior art document describes alloys that do not include zinc (Zn), it indeed indicates that indium (In) is added to decrease the hardness of the alloy and makes no mention whatsoever of any improvement in resistance to tarnishing or alloy hardness.

The prior published U.S. Pat. No. 5,039,479 A describes master alloy compositions for silver alloys that must necessarily comprise a substantial percentage of copper (Cu) and makes no mention of palladium (Pd).

Similarly, the prior art document US2005/186107 A1 describes compositions of the master alloy for coloured silver alloys that must necessarily comprise a substantial percentage of copper (Cu) and zinc (Zn) and, only in certain cases, 1.2% indium (In): this prior art document makes no mention whatsoever of palladium (Pd).

Finally, the prior art document U.S. Pat. No. 5,037,708 A describes a silver alloy obligatorily containing a significant or at least not negligible and not infinitesimal percentage of copper (Cu), and, taking into account its high cost, a significant percentage (between 4% and 9%) of palladium (Pd), added to the alloy in order to improve its resistance to tarnishing and corrosion; in this prior art document, indium (In) and zinc (Zn) are described and provided for as being alternative elements, added in a variable percentage of between 0.5% and 1%, to the silver alloy.

Each of the latter three cited prior art documents describe master alloys and/or ready-to-use silver alloys having formulations designed essentially and exclusively to improve the silver alloys resistance to tarnishing: in particular, none of them mentions any thermo-hardening properties linked to the use in a silver (Ag) alloy, of palladium (Pd) in combination with indium (In) and zinc (Zn).

Despite the many attempts described above, the current market is still dominated by products manufactured from standard sterling silver which, although provided with adequate "as cast" and post-hardening hardness properties, are subjected to simple protective surface treatments, which are organic or galvanic, in order to delay the negative phenomena of tarnishing.

Such protective coating treatments do not in fact solve the problem of ensuring a long-term resistance against the phenomena of tarnishing and furthermore, in particular, galvanic deposits increase production costs in order to ensure appropriate safety measures both for the environment and for the operators who handle hazardous chemicals.

Therefore, in the light of the foregoing, there is still an unmet need for silver alloys that, as well as overcoming the drawbacks of the known solutions listed above, also possess the following characteristics:

- an adequate hardness, be the alloy "as cast", homogenized or hardened by a thermal process, despite their being formulated substantially without copper (Cu);
- a satisfactory and intrinsic resistance to tarnishing, in different corrosive environments (in particular in the presence of sulphur (S) or chlorine (Cl) compounds) and without carrying out surface treatments with organic or galvanic deposits.

The current state of the art includes another unmet need to have master alloys for the production of silver alloys that simultaneously have the desired characteristics of both hardness and resistance to tarnishing.

Finally, there is the unmet need for silver alloys, and corresponding compositions of master alloys which, whilst providing for palladium (a precious material and therefore in itself rather expensive), can be produced economically.

OBJECT AND BRIEF DESCRIPTION OF THE PRESENT INVENTION

The present invention, therefore, starting from the information on the drawbacks and shortcomings in the prior art, intends to satisfy the aforementioned needs and to remedy the present situation.

In particular, the present invention addresses the problem—unresolved or incompletely and unsatisfactorily resolved by the prior technical solutions—of producing sterling silver alloys and corresponding master alloy compositions that simultaneously possess the following characteristics:

- a hardness after hardening by means of a thermal process of about 100-120 HV (that is to say, comparable with that of a standard sterling silver alloy) and preferably also an "as cast" or homogenized hardness of not less than 50-60 HV (i.e. also comparable with that of a standard sterling silver alloy), though being formulated substantially without copper (Cu);
- a satisfactory resistance to tarnishing, for example comparable with that of a premium "9 karat" (equivalent to "375‰") silver-based white gold alloy, in various corrosive environments (especially in the presence of sulphur or chlorine compounds).

Said resistance to tarnishing must be intrinsic to the silver alloy and not obtained by the use of superficial organic or galvanic deposits. We wish to point out here that "9 karat" ("375‰") silver-based white gold alloys are considered to be the minimum reference in terms of resistance to tarnishing, since they do not suffer corrosion in daily use, even in the long term. For the sake of clarity, please note that in the field of goldsmithery and jewellery, the term "karat" is the proportional standard of measurement of the "purity" (or fineness) that quantifies the parts of pure (or fine) gold in an alloy, on a scale of 24/24; in the case of gold alloys, therefore, a "karat" is equivalent lo one part of gold to a total of 24 parts of metal constituting the alloy; it follows, for example, that the wording "9 karat" specifically indicates that the alloy is constituted by 9 parts of fine gold and 15 parts of other metals, while the purest gold is 24 karat (24 parts of "fine" gold to a total of 24 parts).

It is, therefore, main purpose of the present invention to make available both a sterling silver alloy, hardenable by aging and with an improved resistance to tarnishing, and a corresponding master alloy composition, which, including palladium (Pd) in combination with zinc (Zn) and indium (In), achieve all the objectives set out above, and achieve an optimum compromise between the mechanical properties and the costs of the product obtained (final alloy or master alloy composition).

In the course of specific and detailed laboratory research carried out by the Applicant, the latter has, in fact, surprisingly discovered that silver alloys containing essentially palladium (Pd) together with very specific amounts of zinc (Zn) and indium (In), and which are also devoid of copper (Cu), have an excellent hardening ability and, at the same time, guarantee a resistance to tarnishing in both of the corrosive environments (rich in sulphur (S) and/or chlorine (Cl) compounds) that is equal or superior to the abovementioned reference material (a "9 karat" ("375‰") silver-based white gold alloy) and also much higher than the sterling silver alloys currently known.

The Applicant has also discovered that the aforesaid sterling silver alloys containing palladium (Pd) together with zinc (Zn) and indium (In), and in any case devoid of copper (Cu), can tolerate very low concentrations of germanium (Ge) and/or silicon (Si), and should preferably be devoid of them.

The purposes mentioned above are achieved, therefore, by means of a sterling silver alloy hardenable by aging with an improved resistance to tarnishing according to claim 1 attached hereto, to which reference is hereby made for the sake of brevity.

Additional technical features of the age-hardenable sterling silver alloy with improved resistance to tarnishing according to the present invention are contained in the relevant dependent claims 2-6.

Moreover, the present invention also provides for a master alloy composition for the production of sterling silver alloys according to the attached dependent claim 7, to which reference is hereby made for the sake of brevity.

Additional technical features of the master alloy composition are indicated in the respective dependent claims 8-12.

Finally, the present invention also provides for the use of palladium (Pd) in combination with zinc (Zn) and indium (In) in an age-hardenable sterling silver alloy and in a master alloy composition for the production of an age-hardenable sterling silver alloy, respectively, according to attached claims 13 and 14, to which again reference is hereby made for brevity. The above-mentioned claims, specifically defined below, form an integral part of the present description.

A first object of the present invention, possibly independent and autonomously usable with respect to the other aspects of the invention, is a sterling silver alloy, copper-free in its minimal basic formulation, comprising palladium in combination with zinc and indium, having an adequate hardness combined with improved resistance to tarnishing.

Another object of the invention, therefore, possibly independent and autonomously usable with respect to other aspects of the invention itself, is a master alloy composition, copper-free in its minimal basic formulation, comprising palladium in combination with zinc and indium for the production of silver alloys having an adequate hardness combined with improved resistance to tarnishing.

Another object of the invention, therefore, possibly independent and autonomously usable with respect to other aspects of the invention, the use of palladium in combination with zinc and indium in the production of sterling silver alloys and of the corresponding master alloy compositions.

Further advantageous technical features of the silver sterling alloy, the corresponding master alloy composition and of the use of palladium in combination with zinc and indium in the production of sterling silver alloys and the corresponding master alloy compositions, according to the present invention, will become more apparent from the following detailed description of preferred embodiments of the silver alloys, the master alloy compositions and of the uses exclusively claimed herein, given merely by way of non-limiting example.

DETAILED DESCRIPTION OF THE INVENTION

While the invention is susceptible to various modifications and alternative implementations, some embodiments thereof will be described below in detail, in particular by means of some illustrative examples.

It should be understood, however, that there is no intention to limit the invention to the specific forms described here but, on the contrary, the present invention intends to cover all modifications and alternative and equivalent implementations falling within the scope of protection of the present invention as defined in the attached claims.

In the following description, therefore, the use of "e.g.", "etc." and "or" indicates non-exclusive alternatives without limitation, unless otherwise indicated.

The use of the word "also" means "including, but not limited to," unless otherwise indicated. As already briefly anticipated, in the course of the research performed, the Applicant has surprisingly found that silver alloys containing palladium (Pd) along with zinc (Zn) and indium (In), although devoid of copper (Cu), have excellent age-hardening properties and resistance to tarnishing in corrosive environments rich in sulphur (S) and/or chlorine (Cl) compounds.

More precisely, according to the general, essential and main technical aspect of the invention, sterling silver alloys without copper (Cu) and containing

- palladium (Pd) in an amount between 0.7 and 1.9% by weight;
- zinc (Zn) and indium (In) in an amount greater than 2.5% by weight and lower than 6.8% by weight (in essence, therefore, the sum of these two elements—zinc (Zn) and indium (In)—must be not less than 2.5% by weight but not more than 6.8% by weight and both elements must be present, the minimum content of zinc (Zn) or indium (In) being 1%), have a surprising hardening capacity, capable of obtaining hardness values of 100-120 HV, as indicated in the object of the invention.

Such alloys are soft when in the "as cast" or homogenized state, with hardness values lower than 50 HV, but may be hardened up to the above-mentioned values (100-120 HV) by means of a hardening treatment carried out on the "as cast" or previously homogenized material. Furthermore, such alloys guarantee a resistance to tarnishing in environments that are corrosive due to the presence of sulphur (S) and/or chlorine (Cl) compounds, that is at least equal to (or preferably higher than) the previously mentioned reference material (i.e. a silver-based "9 karat", or "375‰", white gold alloy). These alloys show a resistance to tarnishing that is increased by at least 60% compared to currently known sterling silver alloys.

The Applicant has also found that the above-mentioned silver alloys containing palladium (Pd) together with zinc (Zn) and indium (In), and still devoid of copper (Cu), can tolerate very low concentrations of germanium (Ge) and/or silicon (Si) (a maximum of 0.25% both individually and in combination) but, preferably, should be devoid of them in order to avoid the degradation of hardening properties, resistance to tarnishing and ductility, caused by the formation of second phases rich in Pd—Ge and/or Pd—Si in the microstructure.

Furthermore, in order to increase the "as cast" hardness from values lower than 50 HV to values in the range of 50-60 HV without compromising the alloys resistance to tarnishing, the invention tolerates, preferably but not necessarily, the possible addition of copper (Cu) up to a maximum value of 3% by weight and gallium (Ga) and/or tin (Sn) up to a maximum value of 2% by weight.

In general, therefore, a silver alloy according to the main technical concept claimed exclusively by the present invention essentially comprises:

silver (Ag): from 92.5 to 96.8% by weight;
palladium (Pd): 0.7 to 1.9% by weight;
zinc (Zn): 1% to 5.8% by weight;
indium (In): 1% to 5.8% by weight;
sum of zinc (Zn) and indium (In): from 2.5% to 6.8% by weight,
and optionally:
germanium (Ge) and/or silicon (Si): maximum 0.25% by weight;
copper (Cu): maximum 3% by weight;
tin (Sn) and/or gallium (Ga): maximum 2% by weight.

We would like to point out here that the present invention, provides that zinc (Zn) and indium (In) are both present in the final (ready-to-use) alloy and in the master alloy composition with which the final alloy is obtained; therefore, for the purposes of the invention, the sum of the amount of zinc (Zn) and indium (In) that must be simultaneously present is binding, requiring a minimum content of zinc (Zn) or indium (In) of 1% by weight, and that sum must not be less than 2.5% by weight, and more preferably should not be less than 3.75% by weight.

Preferentially, a silver alloy according to a particular aspect of the present invention comprises:

silver (Ag): from 92.5% to 96.6% by weight;
palladium (Pd): from 0.9% to 1.5% by weight;
zinc (Zn): 1% to 5.6% by weight;
indium (In): 1% to 5.6% by weight;
sum of zinc (Zn) and indium (In): from 2.5% to 6.6% by weight.

The embodiments of the invention sterling silver alloy, obtainable by the above-mentioned ranges of values of the essential elements that compose it (i.e. Ag, Pd, Zn, and In), are particularly advantageous and preferable because they allow the above silver alloy to differentiate itself significantly from the more pertinent prior art—comprised of the prior art documents WO2013/057480 A1, US2014/127075 (U.S. Pat. No. 9,267,191 B2), JPS6210231 A (in particular, to be considered the closest prior art), JP1101275726 A and U.S. Pat. No. 8,771,591 B1—inasmuch as they obtain a very good compromise the properties of hardness, resistance to tarnishing and costs (palladium (Pd) percentage present in the alloy especially affecting the latter).

In particular, the use of palladium (Pd) in combination with both zinc (Zn) and indium (In) has a positive effect on the hardness of the alloy, without the need to add copper (Cu), an element well known to be traditionally used to this effect in silver alloys but which, on the other hand, has the equally well-known disadvantage of having a negative impact on the resistance to tarnishing of the alloy itself: in the present invention this parameter is, instead, safeguarded in an adequate and satisfactory way.

The extensive research carried cast by the Applicant on the project related to the present invention has shown that the use of only zinc (Zn) or only indium (In) in this type of formulation does not give the optimal results that are expected and necessary with respect to the surface quality of the micro-fused articles: the presence of only indium (In), or only zinc (Zn) causes the formation of superficial porosity that greatly compromises the achievable final quality.

Therefore, the range of preferred amounts of silver (Ag) and palladium (Pd) to be used is indicated in the above composition.

Even more preferably, a silver alloy according to a secondary aspect of the present invention comprises the essential elements already indicated above but in the following weight percentages:

silver (Ag): from 92.5% to 94% by weight;
palladium (Pd): from 0.9% to 1.5% by weight;
zinc (Zn): 1% to 5.6% by weight;
indium (In): 1% to 5.6% by weight;
sum of zinc (Zn) and indium (In): from 2.5% to 6.6% by weight.

In the above composition the range of the most preferable amounts of silver (Ag) and palladium (Pd) used is always indicated.

A purely preferred but not binding embodiment of the invention, provided in order to increase the "as cast" hardness of the final (ready-to-use) alloy, includes the addition of a quantity of copper (Cu), preferably in the range of 1% to 2.5% by weight.

Another optional embodiment of the invention, again provided in order to increase the "as cast" hardness of the final alloy, comprises the addition of a quantity of tin (Sn) preferably up to a maximum value of 1% by weight; alternatively to tin (Sn), a quantity of gallium (Ga), preferably up to a maximum value of 1% by weight (the same as for tin (Sn)) can be added. Tin (Sn) and gallium (Ga) may also be optionally added to the silver alloy together, always in such a way that their sum does not exceed 2% by weight.

An embodiment of the present invention sterling silver alloy, provided in order to increase the brightness, testability, and resistance to oxidization (firestain, firescale) if copper (Cu) is present in the alloy, and to guarantee its use also in the technique of lost-wax micro-fusion with, pre-set stones, includes the addition of a quantity of germanium (Ge), which forms a protective surface layer of oxides, up to a maximum value of 0.25% by weight; alternatively to germanium (Ge), a quantity of silicon (Si) may be added, which also forms a protective surface layer of oxides, up to a maximum value of 0.25% by weight (the same as for germanium (Ge)).

Further preferred but not limiting embodiments of the sterling silver alloy according to the present invention may include:

the addition of further elements that cooperate in the formation of a protective layer of oxides, such as aluminium (Al), magnesium (Mg), manganese (Mn), titanium (Ti), up to a maximum value of 0.2% by weight;
the addition of elements such as boron (B), indium (Ir), ruthenium (Ru), rhodium (Rh), cobalt (Co), nickel (Ni), and iron (Fe), or of refractory metals such as molybdenum (Mo), vanadium (V) and rhenium (Re), having the function of grain refiners, up to a maximum value of 0.1% by weight;
the addition of elements, such as phosphorus (P) and lithium (Li), which serve as de-oxidants, up to a maximum value of 500 ppm; and
the addition of other noble elements, such as gold (Au) and platinum (Pt), which serve to increase the nobility of the alloy, up to a maximum value of 1% by weight.

Preferably but not exclusively, the above sum of zinc (Zn) and indium (In) in the sterling silver alloy according to the present invention is not less than 3.75% by weight.

The sterling silver alloys according to the present invention have, after age-hardening, a Vickers hardness ranging from about 82 to about 120 HV, the Vickers hardness being determined by applying a load of 200 g, corresponding to 0.2 HV, in compliance with the standard UNI EN ISO 6507: 2005.

The sterling silver alloys according to the present invention advantageously bear a colour change, or tarnishing, with respect to the original colour, expressed as ΔE, which, varies from about 6 to about 15 on the Thioacetamide Corrosion Test (TAA test), according to EN ISO 4538:1998, and from about 0.5 to about 2 on the Perspiration Test, according to EN ISO 12870:2004.

The invention is described in greater detail with reference to a series of examples provided below and summarized in the following Table 2: these examples are intended to be purely illustrative and not limitative of the present invention, and are provided in order to favour their being understood by a person skilled in the art.

Examples of Silver Alloys According to the Invention

As will be seen below, the series of examples here considered and provided comprise three formulations realized according to the prior art and taken as a reference (Table 1), and seven formulations realized according to the teachings of the present invention (Table 2), as well as six formulations realized in order to confirm the validity of the composition ranges identified in the invention (Table 3).

All the samples of the examples given below, typically each of 100 grams in weight, have been prepared by standard processes of induction fusion using graphite crucibles and an argon cover on the molten bath; the casting was performed within graphite moulds in order to obtain bars from which to derive the samples to determine the hardness in the following physical states: "as cast", homogenized, and hardened by heat treatment.

The following tables do not contain the "as cast" hardness values because they are very close to those obtained after homogenization.

The following thermal hardening treatments were carried out:

- homogenization of the samples at 730° C. for 30 minutes followed by immediate cooling in water, and
- tempering at temperatures between 300 and 500° C. for 45 minutes.

It should be noted that the hardening peak for the sterling silver alloy compositions according to the present invention was obtained, typically, after heat treatment at 450-500° C., while the hardening peak for the silver alloys is obtained after treatment at about 300° C.

The Vickers hardnesses were determined by applying a test load of 200 g, corresponding to 0.2 HV, according to UNI EN ISO 6507: 2005.

All the samples of the examples of sterling silver alloys according to the present invention reported below, were also tested for resistance to tarnishing (which notoriously manifests itself as a process of surface blackening that renders the article of jewellery and/or goldsmithery concerned aesthetically unacceptable and not actually wearable), defined as a change in colour with respect to the original colour and expressed as ΔE, by performing laboratory tests in accordance with the following regulations:

- EN ISO 4538:1998, also called the "Thioacetamide (TAA) Test": this test simulates the chemical reaction generated by exposure for 24 hours to an atmosphere rich in sulphur compounds (vapours containing H2S) at a temperature of 20° C.;
- EN ISO12870:2004, also called the "Perspiration (Persp.) Test": this test simulates corrosion in a humid environment rich in chlorine compounds at a temperature of 55° C. for 24 hours; the environment rich in chlorine compounds is obtained by a solution of artificial perspiration.

The tarnishing degree of the tested samples was evaluated by measuring the CIELab colour coordinates on newly prepared samples and on the same samples after the tarnishing test. The degree of tarnishing was expressed as a change of colour with respect to the original colour, by calculating the ΔE values for each sample.

TABLE 1

| | Composition of the alloy [% by weight] | | | | | Hardness [HV 0.2] | | Change of colour [ΔE] | |
|---|---|---|---|---|---|---|---|---|---|
| Sample | Ag | Pd | Zn | In | Other element(s) | After homogenization | After hardening | TAA | Persp. |
| 1.1 | 92.6 | — | — | — | Cu 7.4 | 60 | 140 | 38 | 5 |
| 1.2 | 96.0 | — | 0.5 | — | Cu 2.5 Ge 1.0 | 55 | 115 | 13 | 20 |
| 1.3 | 53 | — | 4 | 1 | Au 37.5. Cu 2 others | — | — | 15 | 2 |

Based on the results given in Table 1, the three samples having compositions according to the prior art, taken as references, show:

1.1: it is an alloy of standard sterling silver having good values for hardness and age-hardening properties but poor resistance to tarnishing especially in an environment rich in sulphur (S) compounds and also very poor resistance to tarnishing in an environment rich in chlorine (Cl) compounds;

1.2: it is an alloy of premium sterling silver (according to current criteria) having good values for hardness and age-hardening properties, improved resistance to tarnishing in an environment rich in sulphur (S) compounds but very poor resistance to tarnishing in an environment rich in chlorine (Cl) compounds;

1.3: It is a silver-based "9 karat" ("375‰") white gold alloy that, as already said, is considered in the industry to be the minimum reference in terms of tarnishing resistance and has then been adopted as the level that must be reached in order to ensure an adequate tarnishing resistance; the hardness values for this alloy aren't shown since not relevant in this context.

From the data given in Table 2 it is evident that, advantageously, the improvement in tarnishing resistance required for sterling silver alloys according to the present invention is at least equal to 60% with respect to a standard known type sterling silver alloy (Sample 1.1).

TABLE 2

| | Composition of the alloy [% by weight] | | | | | Hardness [HV 0.2] | | Change of colour [ΔE] | |
|---|---|---|---|---|---|---|---|---|---|
| Sample | Ag | Pd | Zn | In | Other element(s) | After homogenization | After hardening | TAA | Persp. |
| 2.1 | 92.6 | 0.8 | 3.3 | 3.3 | — | 42 | 82 | 8 | 1 |
| 2.2 | 92.6 | 1.5 | 1 | 4.9 | — | 45 | 115 | 10 | 0.5 |
| 2.3 | 92.6 | 1.5 | 4.9 | 1 | — | 45 | 116 | 10 | 0.5 |
| 2.4 | 92.6 | 1.9 | 2.75 | 2.75 | | 46 | 120 | 13 | 1 |
| 2.5 | 96 | 1 | 1.5 | 1.5 | — | 41 | 90 | 7.5 | 1 |
| 2.6 | 92.6 | 1.5 | 1.2 | 2.7 | Cu 2.0 | 50 | 120 | 12 | 1.5 |
| 2.7 | 92.6 | 1.5 | 1.2 | 1.7 | Cu 2.0 Sn 1.0 | 58 | 95 | 15 | 2 |

Based on the results given in Table 2, the seven samples having compositions according to the present invention show:

from 2.1 to 2.4: they are alloys with a silver (Ag) fineness equal to 92.6% by weight (i.e. the standard fineness for sterling silver), in which zinc (Zn) and indium (In) have completely replaced copper (Cu); these alloys have heat treatment hardening properties and their peak hardness after hardening grows steadily with the increase in Pd content (0.8 to 2.5 to 1.9% by weight), up to the characteristic peak hardness of the reference silver alloys (sample 1.1 and sample 1.2); the resistance to tarnishing of these alloys is considerably higher, in both environments, than that of the reference silver alloys and is superior to that of the silver-based "9 karat" ("375‰") white gold alloy (Sample 1.3). These examples clearly show that to obtain the desired hardening properties, the palladium (Pd) must be present in a minimum amount of about 0.7% by weight; these alloys, made according to the innovative concept of the present invention, demonstrate that the zinc (Zn) and indium (In) totally replace the copper (Cu) in the composition and have influence on its propensity to hardening and resistance to tarnishing;

2.5: it is an alloy according to the present invention with a silver content increased to 96% by weight; this example clearly shows that the hardening properties are due to the simultaneous introduction of first palladium (Pd) and then zinc (Zn) and indium (In), and also that, in order to get the desired hardening properties, the amount of zinc (Zn) and indium (In) should not be less than 2.5% by weight, more preferably not less than 3.75% by weight;

2.6: it is an alloy according to the invention that also includes copper (Cu) in the composition, added because some applications may require the presence of this element in order to increase the so-called "as cast" hardness.

Generally, tarnishing resistance is degraded by adding copper but, as this example shows, a small copper addition doesn't cause a decrease in tarnishing resistance that, moreover, is still higher than that of the silver-based "9 karat" ("375‰") white gold alloy (sample 1.3);

2.7: it is an alloy according to the present invention with the addition of copper (Cu) and tin (Sn) to further increase the hardness (gallium (Ga) may be used as an alternative to tin (Sn)); this example shows that in order to avoid degrading the resistance to tarnishing to an unacceptable level, the addition of tin (Sn) and/or gallium (Ga) must not exceed a maximum value of 2% by weight for the sum of these elements, and should preferably be limited to a maximum value of 1% by weight for each element.

TABLE 3

| | Composition of the alloy [% by weight] | | | | | Hardness [HV 0.2] | | Change of colour [ΔE] | |
|---|---|---|---|---|---|---|---|---|---|
| Sample | Ag | Pd | Zn | In | Other element(s) | After homogeniza-tion | After hard-ening | TAA | Persp. |
| 3.1 | 92.6 | 0 | 3.7 | 3.7 | — | 36 | 36 | 4 | 2 |
| 3.2 | 92.6 | 0.6 | 3.4 | 3.4 | — | 38 | 62 | 6 | 1 |
| 3.3 | 96.8 | 1.2 | 1 | 1 | — | 34 | 48 | 8 | 1 |
| 3.4 | 92.6 | 2.1 | 1.3 | 4 | — | 47 | 106 | 16 | 3 |
| 3.5 | 92.6 | 5.5 | 0.7 | 4.7 | Ge 0.5 | 45 | 82 | 18 | 1.3 |
| 3.6 | 92.6 | 1.5 | 1.2 | 1.2 | Cu 3.5 | 60 | 130 | 20 | 3 |

3.1: it is an alloy that does not contain palladium (Pd) and in which zinc (Zn) and indium (In), in equal quantities, completely replace the copper (Cu): it has low hardness and is not hardenable by aging;

3.2: it is an example of an alloy having a silver (Ag) content equal to 92.6% by weight (i.e. the standard fineness for sterling silver) and a content of palladium (Pd) equal to 0.6% by weight; the data illustrate that with this content of palladium (Pd), the thermo-hardening properties are minimal, and the hardnesses that can be obtained are not comparable to those of a standard sterling silver alloy. On the basis of these results, it is evident that the content of palladium (Pd) of 0.7% by weight is to be regarded as the minimum acceptable amount.

3.3: it is an example of an alloy having a silver (Ag) content equal to 96.8% by weight (i.e. higher than the standard fineness for sterling silver) and with a content of palladium (Pd) equal to 1.2%, therefore within the range provided for by the present invention for this specific element. The sum of zinc (Zn) and indium (In) is however equal to 2% (therefore not within the range provided for by the present invention for the sum of these elements). This example shows that when the sum values of zinc (Zn) and indium (In) are less than 2.5% the thermo-hardening characteristics obtainable with the invention are not present. On the basis of these data, it is apparent that a sum of zinc (Zn) and indium (In) equal to 2.5% by weight is to be regarded as the minimum acceptable amount.

3.4: it is another example of an alloy having a silver (Ag) content equal to 92.6% by weight (i.e. the standard fineness for sterling silver) and with a content of palladium (Pd) equal to 2.1% by weight, therefore not within the range provided for by the present invention for this specific element; the data illustrate that the hardness peak has reached a plateau and, therefore, there is no benefit in terms of hardening properties deriving from the further increase in the content of palladium (Pd); furthermore, it is evident that resistance to tarnishing is also slightly but continuously degraded by the additions of palladium (Pd), so that a content of palladium (Pd) of 1.9% by weight is to be regarded as the maximum acceptable amount.

3.5: it is an alloy with a substantial content of germanium (Ge), inasmuch as in some applications the presence of said element (or, alternatively, of silicon (Si)) may be required to improve the colour of the ahoy in its "as cast" state through the formation of a colourless surface oxide.

However, this example shows that the addition of one of these elements degrades both the hardening properties and the resistance to tarnishing of the ahoy compositions according to the present invention, which degradation is believed to be caused, without intention of being bound by this theory, by the undesired formation of second phases rich in Pd—Ge and Pd—Si in the material microstructure.

The addition of germanium (Ge) or silicon (Si), therefore, should be limited to a maximum value of 0.25% by weight (for each element) so as to maintain the properties of the alloys in accordance with the present invention. For the same reason, although not shown with specific examples, additions of other elements such as aluminium (Al), titanium (Ti), magnesium (Mg), or manganese (Mn) must be limited to a maximum value of 0.2% by weight for each element.

3.6: is another example of an alloy with a more substantial content of copper: it shows how, in optional compositions according to the present invention, the maximum permissible amount of copper is about 3% by weight, preferably between 1 and 2.5% by weight for an acceptable compromise between the increase in hardness and sufficient resistance to tarnishing.

As already mentioned, one object of the present invention, optionally autonomously usable with respect to the others, is also a master alloy composition for the production of age-hardenable silver alloys having an improved resistance to tarnishing compared to the current prior art.

According to the general technical aspects of the present invention, the master alloy composition for the production of a sterling silver alloy comprises at least:

palladium (Pd): from 9.33% to 43.18% by weight, and
zinc (Zn): from 13.33 to 77.33% by weight;
indium (In): from 13.33 to 77.33% by weight;
sum of zinc (Zn) and indium (In): not more than 90.67% by weight,
and optionally one or more of the elements selected from the group consisting of:
germanium (Ge) and/or silicon (Si): maximum 7.25% by weight;
tin (Sn) and/or gallium (Ga): maximum 38.46% by weight;
copper (Cu): maximum 48.39% by weight.

In the event that said master alloy composition optionally contains copper (Cu) and other elements, the percentage by weight of these is not more than 57.33%.

Therefore, when the palladium (Pd) in a final (ready-to-use) sterling silver alloy is between 0.7% and 1.9% by weight, the master alloy composition according to the main core of the present invention includes, as has just been stated:

palladium (Pd): from 9.33% to 43.18% by weight, and
sum of zinc (Zn) and indium (In): at most equal to 90.67% by weight.

Again preferably, and more in detail, when the silver (Ag) In a final silver alloy is between 92.5% and 96.6% and the palladium (Pd) in the final silver alloy is between 0.9% and 1.5% by weight, the master alloy composition of the invention comprises:

palladium (Pd): from 12.00% to 37.50% by weight, and
zinc (Zn): from 13.33 to 74.67% by weight;
indium (In): from 13.33 to 74.67% by weight;
sum of zinc (Zn) and indium (In): at most equal to 88.00% by weight.

If said master alloy composition contains copper (Cu) and other elements, the percentage by weight of these is not more than 54.67%.

Preferably but not necessarily, when the silver (Ag) in a final silver alloy is comprised between 92.5% and 94.0% by weight and the palladium (Pd) in the final silver alloy is between 0.9% and 1.5% by weight, the master alloy composition according to the present invention comprises:

palladium (Pd): from 12.00% to 25.00% by weight, and
zinc (Zn): from 13.33 to 74.67% by weight;
indium (In): from 13.33 to 74.67% by weight;
sum of zinc (Zn) and indium (In): at most equal to 88.00% by weight.

If said master alloy composition contains copper (Cu) and other elements, the percentage by weight of these is not more than 34.67%.

Preferably but not bindingly, generally, the master alloy composition according to the present invention provides that the sum of zinc (Zn) and indium (In) is not less than 50% by weight.

Equally preferably and generally, the tin (Sn) and/or gallium (Ga) included, in the master alloy composition according to the present invention have a maximum value equal to 23.81% by weight.

In addition, preferably but not necessarily, the copper (Cu) included in the master alloy composition according to the present invention has a value of between 13.33 and 43.86% by weight.

Optionally, the master alloy composition may also include:

aluminium (Al), magnesium (Mg), manganese (Mn), titanium (Ti): from 0% to 10.26% by weight;
boron (B), indium (Ir), ruthenium (Ru), rhodium (Rh), cobalt (Co), nickel (Ni), iron (Fe), molybdenum (Mo), vanadium (V) and rhenium (Re): from 0% to 5.41% by weight;
phosphorus (P) and lithium (Li); from 0% to 2.78% by weight;
gold (Au) and platinum (Pt): from 0% to 36.36% by weight.

It is important to note that the addition of the newly introduced optional elements to the master alloy composition of the present invention will cause a consequential change to (or balancing of) the essential elements of the master alloy composition, i.e. in the first instance palladium (Pd) and secondly zinc (Zn) and indium (In).

The specific and salient aspects of the present invention are described in greater detail with reference to a series of examples below; said examples being intended as illustrative but not limitative of the present invention.

Examples of Master Alloy Compositions According to the Invention

The examples of alloy and master alloy formulations which are shown in Table 4, Table 5, Table 6 and Table 7 below show that:

the concentration of palladium (Pd) is comprised between a minimum value equal to 9.33% by weight (Ex. 4.1 in Table 4) and a maximum value equal to 43.18% by weight (Ex. 4.2 in Table 4);

in combination with the fact that:

the sum of zinc (Zn) and indium (In) in the composition has a minimum value equal to 33.33% by weight (Ex. 4.3 of Table 4) and a maximum value equal to 90.67% by weight (Ex. 4.1 of Table 4).

It is evident that the compositions of these master alloys according to the present invention are modified by the preferred content of palladium (Pd) that is included, as well as by the fineness of the Silver (Ag) provided for in the final alloy.

Example 4.1 shows that the minimum content of palladium (Pd) in the master alloy according to the present invention is equal to 9.33% and that the sum of zinc (Zn) and indium (In) in the composition has a maximum value equal to 90.67% by weight.

Example 4.2, shows that the maximum content of palladium (Pd) in the master alloy according the present invention is equal to 43.18% by weight. This value is obtained in combination with the minimum value that the sum of zinc (Zn) and indium (In) can have and that is equal to 2.5% by weight in the final silver alloy.

Example 4.3 shows that the maximum value that the sum of copper (Cu) and/or other elements may have in the master alloy is equal to 57.33% by weight. This value is obtained by using the minimum acceptable content of silver (Ag), palladium (Pd) and the sum of zinc (Zn) and indium (In) in the final silver alloy.

In example 4.4 the master alloy composition according the present invention is calculated by providing for the maximum amount of silver (Ag) in the final sterling silver alloy that is equal to 96.8% by weight.

In examples 4.5 and 4.6, the compositions of the master alloys according the present invention are calculated by providing for a content of palladium (Pd) of between 0.9% by weight and 1.5% by weight without the addition of any of the optional elements previously listed.

In example 4.7 the master alloy composition according the present invention is calculated by providing for a content of palladium equal to 0.9% by weight, the sum of zinc (Zn) and indium (In) equal to 2.5% by weight and the minimum quantity of silver (Ag) allowable according to the present invention, equal to 92.5% by weight. This example shows that the percentage of copper (Cu) and/or other elements in this combination is equal to 54.67% by weight.

In example 4.8 the master alloy composition according the present invention is calculated on the basis of a content of silver (Ag) in the final (ready-to-use) alloy equal to 96.6% by weight and on a content of palladium (Pd) equal to 0.9% by weight and the sum of zinc (Zn) and indium (In) equal to 2.5% by weight.

In examples 4.9 and 4.10 the master alloy composition is calculated by including a content of Silver (Ag) in the final alloy of 94% by weight. In example 4.10 optional elements such as copper (Cu) and/or other metals are also included in the master alloy.

In Examples 4.11 to 4.14, the master alloy compositions according to the present invention comprise a content of zinc (Zn) and indium (In) equal to 3.75% by weight.

TABLE 4

| | Ag [% by weight] | Pd [% by weight] | Zn and/or In [% by weight] | Cu and/or other elements [% by weight] |
|---|---|---|---|---|
| 4.1 - Ag alloy | 92.5 | 0.7 | 6.8 | 0.00 |
| 4.1 - Corresponding master alloy | — | 9.33 | 90.67 | 0.00 |

TABLE 4-continued

| | Ag [% by weight] | Pd [% by weight] | Zn and/or In [% by weight] | Cu and/or other elements [% by weight] |
|---|---|---|---|---|
| 4.2 - Ag alloy | 95.6 | 1.9 | 2.5 | 0.00 |
| 4.2 - Corresponding master alloy | — | 43.18 | 56.82 | 0.00 |
| 4.3 - Ag alloy | 92.5 | 0.7 | 2.5 | 4.3 |
| 4.3 - Corresponding master alloy | — | 9.33 | 33.33 | 57.33 |
| 4.4 - Ag alloy | 96.8 | 0.7 | 2.5 | 0.00 |
| 4.4 - Corresponding master alloy | — | 21.88 | 78.125 | 0.00 |
| 4.5 - Ag alloy | 92.5 | 0.9 | 6.6 | 0.00 |
| 4.5 - Corresponding master alloy | — | 12.00 | 88.00 | 0.00 |
| 4.6 - Ag alloy | 96.0 | 1.5 | 2.5 | 0.00 |
| 4.6 - Corresponding master alloy | — | 37.50 | 62.50 | 0.00 |
| 4.7 - Ag alloy | 92.5 | 0.9 | 2.5 | 4.1 |
| 4.7 - Corresponding master alloy | — | 12.00 | 33.33 | 54.67 |
| 4 8 - Ag alloy | 96.60 | 0.90 | 2.50 | 0.00 |
| 4.8 - Corresponding master alloy | — | 26.47 | 73.53 | 0.00 |
| 4.9 - Ag alloy | 94 | 1.5 | 4.5 | 0 |
| 4.9 - Corresponding master alloy | — | 25.00 | 75.00 | 0.00 |
| 4.10 - Ag alloy | 94 | 0.90 | 2.50 | 2.6 |
| 4.10 - Corresponding master alloy | — | 15.00 | 41.67 | 43.33 |
| 4.11 - Ag alloy | 92.5 | 0.7 | 3.75 | 3.05 |
| 4.11 - Corresponding master alloy | — | 9.33 | 50.00 | 40.67 |
| 4.12 - Ag alloy | 94.35 | 1.9 | 3.75 | 0 |
| 4.12 - Corresponding master alloy | — | 33.63 | 66.37 | 0.00 |
| 4.13 - Ag alloy | 92.5 | 0.9 | 3.75 | 2.85 |
| 4.13 - Corresponding master alloy | — | 12.00 | 50.00 | 38.00 |
| 4.14 - Ag alloy | 94.75 | 1.5 | 3.75 | 0 |
| 4.14 - Corresponding master alloy | — | 28.57 | 71.43 | 0.00 |

TABLE 5

| | Ag [% by weight] | Pd [% by weight] | Zn and/or In [% by weight] | Sn and/or Ga [% by weight] |
|---|---|---|---|---|
| 5.1 - Ag alloy | 94.8 | 0.7 | 2.5 | 2.00 |
| 5.1 - Corresponding master alloy | — | 13.46 | 48.08 | 38.46 |
| 5.2 - Ag alloy | 95.8 | 0.7 | 2.5 | 1.00 |
| 5.2 - Corresponding master alloy | — | 16.67 | 59.52 | 23.81 |

In example 5.1 the master alloy composition according the present invention is calculated by providing for a content of palladium (Pd) equal to 0.7% by weight the sum of zinc (Zn) and indium (In) equal to 2.5% by weight and a maximum allowable content of tin (Sn) and/or gallium (Ga) equal to 2% by weight in the final silver alloy. This example shows that according to the present invention fire maximum percent of tin (Sn) and/or gallium (Ga) to be optionally added to the master alloy is equal to 38.46% by weight.

In example 5.2 the master alloy composition of the invention is calculated by providing for a content of palladium (Pd) equal to 0.7% by weight a sum of zinc (Zn) and indium (In) equal to 2.5% by weight and a content of tin (Sn) and/or gallium (Ga) equal to 1% by weight in the final silver alloy. This example shows that according to the invention the percentage of tin (Sn) and/or gallium (Ga) optionally added to the master alloy is equal to 23.81% by weight.

TABLE 6

| | Ag [% by weight] | Pd [% by weight] | Zn and/or In [% by weight] | Cu [% by weight] |
|---|---|---|---|---|
| 6.1 - Ag alloy | 93.8 | 0.7 | 2.5 | 3.00 |
| 6.1 - Corresponding master alloy | — | 11.29 | 40.32 | 48.39 |
| 6.2 - Ag alloy | 94.3 | 0.7 | 2.5 | 2.50 |
| 6.2 - Corresponding master alloy | — | 12.28 | 43.86 | 43.86 |
| 6.3 - Ag alloy | 95.8 | 0.7 | 2.5 | 1.00 |
| 6.3 - Corresponding master alloy | — | 16.67 | 59.52 | 23.81 |

In examples 6.1, 6.2 and 6.3 the master alloy compositions according the present invention are calculated by providing for a content of palladium (Pd) equal to 0.7% by weight, a sum of zinc (Zn) and indium (In) equal to 5% by weight. The content of copper (Cu) allowed is however modified from a maximum of 3% by weight to 1% by weight in the final alloy. These three examples demonstrate that according to the invention the maximum percentage of copper (Cu) admitted in the master alloy is equal to 48.39% by weight, and the same can also be equal to 43.86% by weight or to 23.81% by weight.

TABLE 7

| | Ag [% by weight] | Pd [% by weight] | Zn and/or In [% by weight] | Ge and/or Si [% by weight] |
|---|---|---|---|---|
| 7.1 - Ag alloy | 96.55 | 0.7 | 2.5 | 0.25 |
| 7.1 - Corresponding master alloy | — | 20.29 | 72.46 | 7.25 |

In example 7.1, the master alloy composition according the present invention is calculated by providing for a content of palladium (Pd) equal to 0.7% by weight, a sum of zinc (Zn) and indium (In) equal to 2.5% by weight and a maximum content of germanium (Ge) and/or silicon (Si) equal to 0.25% by weight in the final silver alloy. This example shows that according to the invention the maximum percentage of germanium (Ge) and/or Silicon (Si) allowable in the master alloy is equal to 7.25% by weight.

As already mentioned, one object of the present invention, optionally autonomously usable with respect to the others, is also the use of palladium (Pd) in combination with zinc (Zn) and indium (In) in an age-hardenable silver alloy to improve hardness in the age-hardened state and resistance to tarnishing.

Moreover, as already mentioned above, another object of the present invention, optionally autonomously usable with respect to the others, is the use of palladium (Pd) in combination with zinc (Zn) and indium (In) as a master alloy composition, for the production of an age-hardenable silver alloy to improve the hardness in the age-hardenable state and resistance to tarnishing of said silver alloy.

On the basis of the above, it is clear, therefore, that the sterling silver alloy, the master alloy composition for the production of said an age-hardenable silver alloy and the uses described in the present invention achieve the aims and advantages mentioned previously.

It is evident that, without compromising the desired hardening properties or resistance to tarnishing, the silver alloy (or its master alloy composition according to the present invention) may also comprise:

- small additions (no greater than 1% by weight) of precious metals such as gold or platinum, to increase the nobility of the alloys;
- one or more of the grain refining elements useful during the melting or the processing of alloys, added in amounts up to a maximum of 0.1% by weight; such grain refining elements can include, for example, boron, indium, ruthenium, rhodium, cobalt, nickel, iron, and refractory metals such as molybdenum, vanadium and rhenium; and
- one or more of the deoxidizing elements, such as phosphorus or lithium, added in amounts up to a maximum of 0.05% by weight; these elements, traditionally provided for in the industrial production of silver alloys, can also be added in the production of the alloys described in the present invention.

We hereby reiterate that the invention described is based on the use of palladium (Pd) in combination with zinc (Zn) and indium (In) in both a sterling silver alloy and a master alloy for its production, in order to guarantee thermo-hardening properties in sterling silver alloys devoid of copper (Cu): obtaining an improvement of the resistance to tarnishing of the silver alloy is only a consequence of the formulation studied by the Applicant in order to achieve the above-mentioned thermo-hardening properties.

With respect to the prior art closest to it, represented by prior art document JPS6210231A, the invention implements an inventive and innovative selection of the respective composition ranges of palladium (Pd) and of the sum of zinc (Zn) and indium (In), three of the four essential elements in the ready-for-use age-hardenable sterling silver alloy claimed herein.

More specifically, as far as its formulation is concerned, the sterling silver alloy according to the present invention significantly differs from the alloys of said prior art document, as can also be seen from a comparison of the present invention with the examples in table 1 of JPS6210231 which, allowing an interpretation of the content of the claims (as stipulated by law):

- when they provide simultaneously for palladium (Pd), zinc (Zn) and indium (In), show a silver content (90% Ag) that is extraneous to the present invention and not exclusively claimed by same (92.5%÷96.8%), or a significant content: of palladium (Pd) (2.5%), extraneous to the present invention and not exclusively claimed by same (0.7%÷1.9%);
- when they provide for a content of silver (92.5% Ag) ascribable to that claimed exclusively by the present invention (92.5%–96.8%), do not include at least one of the essential elements of same, namely palladium (Pd) or zinc (Zn) or a significant (2.5%) content of palladium (Pd), extraneous to the present invention and not claimed exclusively by same (0.7÷1.9%).

From a conceptual point of view, the prior art document JPS6210231 A is aimed at improving the resistance of silver alloys to tarnishing and does not in any way mention the ability of same to improve the hardness or the thermo-hardening properties of sterling silver alloys devoid of copper (Cu) which, as is apparent from the preamble of the main claim of the silver alloy of said invention, represents the inventive heart of the latter.

Compared to this prior art document, the present invention is differentiated by the fact that it specifically indicates the improved thermo-hardening properties in the absence of copper (Cu) of sterling silver alloys in combination with art optimal resistance to tarnishing: the data obtained by the Applicant show, in fact, that levels of palladium (Pd) greater than 2% in combination with zinc (Zn) and indium (In) do not allow an alloy to exceed a hardness of 120 HV after heat-hardening and do not even guarantee a better resistance to tarnishing. For the purposes of the present invention, therefore, it is important not to exceed 2% palladium (Pd) in the final sterling silver alloy.

Even more particularly, the technical teaching proposed by the prior art document U.S. Pat. No. 5,039,479 A (or by the prior art document US2005/186107 A1) cited above, when evaluated in combination with the technical teaching proposed by the above-mentioned prior art document U.S. Pat. No. 5,037,708 A, are in no way capable of affecting the validity (in particular with reference to its originality) of the technical subject matter claimed exclusively in the present invention and this due to the fact that:

- the prior art document U.S. Pat. No. 5,039,479 A (or the prior art document US2005/186107 A1) always provides for copper (Cu) in the formulation—which is not necessary and not essential to the invention—;
- the prior art document U.S. Pat. No. 5,037,708 A provides for palladium (Pd) but in much, higher concentrations—though they are already high in absolute terms—than those provided for by the technical subject matter claimed exclusively by the present invention, which we hereby reiterate is in the range of 0.7%÷1.9% in the age-hardenable sterling silver alloy;
- none of these prior documents aims to improve the hardness, by thermo-hardening, of the ready-to-use sterling silver alloy.

It follows that a person skilled in the art, by combining; the prior art document U.S. Pat. No. 5,039,479 A (or the prior art document US2005/186107 A1) with the prior art document U.S. Pat. No. 5,037,708 A, will not be able to extract or somehow deduce the technical subject matter claimed exclusively by the present invention which, therefore, with respect to said prior art documents, meets all the requirements for a valid patent.

The sterling silver alloy and the master alloy composition with which, same is obtained, according to the present invention, in their main basic version, do not provide for the use of copper (Cu) and, when they do include it (in a preferred but not binding embodiment), the amount of this element (Cu) added is decidedly lower than that of equivalent silver alloys and master alloy compositions, without this negatively impacting on the properties of the final alloy hardness and at the same time providing excellent resistance to tarnishing (which is known to be affected by the presence of copper (Cu), as noted above): this stems from the provision for a combination of palladium (Pd), zinc (Zn) and indium (In), in respective specific percentages, in the age-hardenable silver alloy and master alloy composition of the present invention.

Lastly, it is clear that numerous other variations cart be applied to the sterling silver alloy and the master alloy composition in question, without departing from the scope of protection defined by the claims that follow, as it is also clear that in the practical implementation of the present invention, the materials, forms and dimensions of the details illustrated can be any whatsoever, according to specific requirements, and can be replaced with other technically equivalent ones.

The invention claimed is:

1. An age hardenable sterling silver alloy consisting of:

from 92.5 to 96.8% by weight silver;

from 0.7 to 1.9% by weight palladium, and a sum total of from 2.5 to 6.8% by weight of zinc and indium, wherein zinc and indium are both present in the age hardenable sterling silver alloy;

from 0 to 0.25% of germanium or silicon;

from 0 to 3% of copper;

from 0 to 2% of tin or gallium.

2. The age hardenable sterling silver alloy of claim 1, consisting of: 92.6% by weight silver; 1.5% by weight palladium; 1.2% by weight zinc; 2.7% by weight indium;

2% by weight copper;

wherein zinc and indium are both present in the age hardenable sterling silver alloy.

* * * * *